United States Patent [19]

Masui

[11] Patent Number: 4,549,423

[45] Date of Patent: Oct. 29, 1985

[54] SCREW BODY JACK AND A BODY JACK ASSEMBLY

[75] Inventor: Saburo Masui, Tokyo, Japan

[73] Assignee: Yasui Sangyo Co., Ltd., Japan

[21] Appl. No.: 469,012

[22] Filed: Feb. 23, 1983

[51] Int. Cl.[4] ..... B21D 1/12

[52] U.S. Cl. ..... 72/295; 72/305; 72/705

[58] Field of Search ..... 72/295, 301, 302, 305, 72/308, 309, 705; 254/98, 100

[56] References Cited

U.S. PATENT DOCUMENTS

| | | | |
|---|---|---|---|
| 1,397,465 | 11/1921 | Steffey | 254/100 |
| 2,340,587 | 2/1944 | Graham | 72/305 |
| 2,371,659 | 3/1945 | Stultz | 72/705 |
| 2,463,966 | 3/1949 | Hauschild | 72/301 |
| 2,627,295 | 2/1953 | Jackson | 72/302 |
| 2,725,917 | 12/1955 | Kauppi | 72/705 |
| 2,736,359 | 2/1956 | Bowman | 72/302 |
| 2,956,458 | 10/1960 | Hougen | 72/302 |
| 3,015,353 | 1/1962 | Brown | 72/302 |
| 3,760,625 | 9/1973 | Archambault | 72/705 |

*Primary Examiner*—Lowell A. Larson

*Attorney, Agent, or Firm*—Hayes, Davis & Soloway

[57] ABSTRACT

Disclosed are a screw body jack which can correct the deformation of a metallic structure with the force derived from screw mechanism and a body jack assembly which makes use of a plurality of body jack elements extending radially from a central bracket piece over an angle of either in excess of 180 degrees or no more than 180 degrees. In the latter case, at least one of the body jack elements is utilized in tension while the others are in compression. The screw body jack may be advantageously utilized in the body jack assembly because of its functionality and simplicity.

5 Claims, 10 Drawing Figures

SCREW BODY JACK AND A BODY JACK ASSEMBLY

BACKGROUND OF THE INVENTION

This invention generally relates to a screw body jack and a body jack assembly and in particular to a screw body jack and a body jack assembly for correcting the deformation of a car body or for deforming a metallic structure in general.

It is generally known to use a hydraulic jack for correcting the deformation of a car body which commonly arises from a car accident. And a variety of such body jacks and body jack kits are commercially available. But such hydraulic jacks are known to have various shortcomings.

First when correcting a local deformation of an integral body member such as a rear panel of a passenger car it is necessary to fix the body member to a post secured to the floor or a bench to support the reaction force arising as the cylinder of the body jack applies force to the body member. As a result, considerable time must be spent for preparatory work and additional space becomes necessary.

Second such a hydraulic jack is generally capable of producing force only in one direction at a time and, when correcting the deformation of an opening in one direction, a new deformation is often caused in other directions and corrections must be repeated over and over again before overall correction of the initial deformation is attained.

Third a hydraulic cylinder is generally so heavy that the user thereof gets tired very quickly from using it. And while a hydraulic jack can produce a large stroke very easily it can not produce small stroke with any accuracy, making it unsuitable for use in correcting small deformations.

SUMMARY OF THE INVENTION

In view of such shortcomings of conventional hydraulic jacks for correcting the deformation of a car body, a primary object of this invention is to provide a body jack which is simple and convenient for correcting the deformations of various nature and a body jack assembly which can achieve comprehensive correction of the deformation of a metallic body member through unique combination of various body jack elements.

Another object of this invention is to provide a body jack assembly which can achieve a wide range of pushing and pulling work through combination of various body jack elements.

Yet another object of this invention is to provide a body jack and a body jack assembly which are highly stable and are therefore highly suitable for use as a jig when replacing part of a car body.

Yet another object of this invention is to provide a body jack and a body jack assembly which do not require extra facilities for supporting the reaction force produced in the process of correcting metallic frame deformation.

According to the present invention, such objects are accomplished by providing a screw jack for correcting the deformation of a metallic structure or for deforming a metallic structure, comprising a hollow cylindrical tube having an internal thread at one end and a coupling means at the other end, a screw rod having an external thread engageable with the internal thread of the cylindrical tube and extending over a substantial length thereof, a means for rotating the screw rod about the longitudinal axis thereof and a coupling means at one end and a pair of clamps each having means for secure engagement with a metallic member whose deformation is to be corrected and a means for pivotal connection with the coupling means of the screw rod or the cylindrical tube, and a body jack assembly for correcting the deformation of a metallic structure or for deforming a metallic structure, comprising at least one screw body jack element whose length may be adjusted even under tension or compression, at least two more body jack elements which are capable of supporting either compression or tension, a central bracket piece having a coupling means for pivotally connecting one ends of the body jack elements and clamping means which may be securely clamped on the metallic structure whose deformation is to be corrected and are each adapted for pivotal connection with the other end of each of the body jack elements.

BRIEF DESCRIPTION OF THE DRAWINGS

Now the present invention is described in the following with reference to the appended drawings, in which.

DESCRIPTION OF THE PREFERRED EMBODIMENTS

Figure 1:
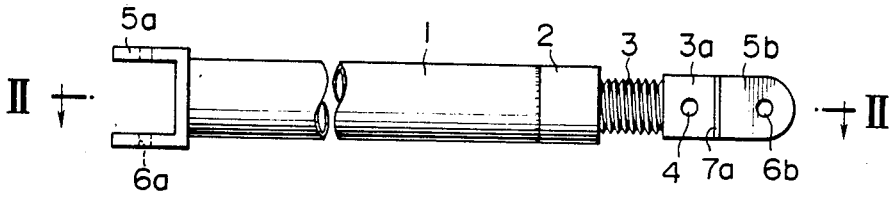
FIG. 1 is a side view of an embodiment of a screw body jack according to this invention.

In FIG. 1, numeral 1 denotes a hollow cylindrical tube with one end welded to an extension member 2 having an internal thread and the other end likewise welded to a U-shaped bracket 5*a* having nutually aligned hole 5*a* in its two pronged free ends.

The internal thread of the extension member 2 is threadaly engaged with an external thread of a screw rod 3 having a head 3*a* with a lateral through hole 4. And these threads are preferably made of the trapezoidal type threads as they can offer a greater mechanical strength. The external end of the screw rod head 3*a* is engaged with another U-shaped bracket 5*b* similar to the bracket 5*a* having a pair of mutually aligned holes 6*b* by way of a pair of bushings 7*a* and 7*b*. These bushings 7*a* and 7*b* allow the rotation of the screw rod 3 relative to the bracket 5*b* to be made with small friction.

Figure 2:
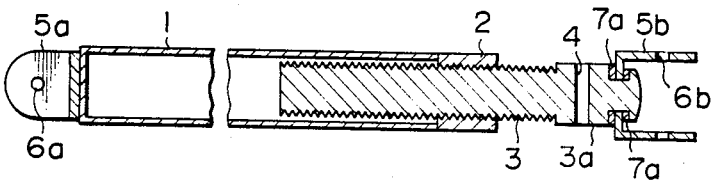
FIG. 2 is a longitudinal sectional view taken along line II—II of FIG. 1.
Figure 3:
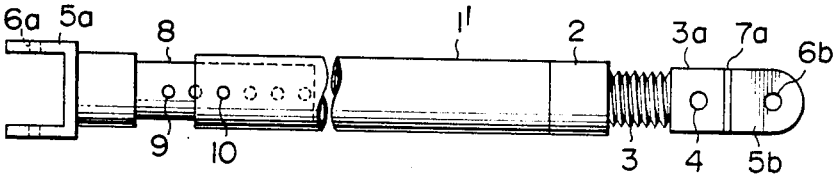
FIG. 3 is a side view of another embodiment of a screw jack according to this invention.

FIG. 3 shows another embodiment of the screw body jack according to this invention. This screw body jack is similar in structure to the one shown in FIGS. 1 and 2 but has a telescopic structure consisting of a hollow cylindrical outer tube 1' and an internal tube 8 each having holes 9 and 10 along their sides. In this embodiment, the external tube 1' has two longitudinally arranged holes while the internal tube 8 has a number of longitudinally arranged holes 9 so that the overall length of the telescopically combined totality may be freely adjusted and fixed by inserting a U-shaped pin which is not shown in the drawings through the holes 9 and 10 of the internal and the external tubes 8 and 1'.

Figure 4A:
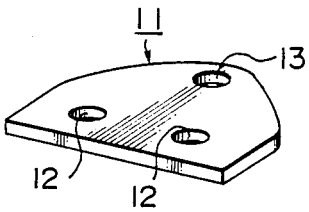
FIGS. 4*a* and 4*b* are perspective views showing two kinds of clamp piece halves.

FIG. 4*a* shows a half 11 of a clamp which may be used for engaging the two ends of a screw body jack to a metallic body structure. Each clamp half has three holes, of which one hole is used for pivotally connecting this clamp to the bracket 5*a* or 5*b* of a body jack element by way of a pin while two others are used for securely fastening the clamp onto a metallic frame whose deformation is to be corrected by way of two bolt-and-nut pairs.

Figure 4B:
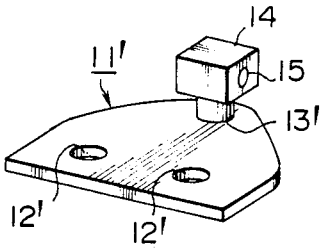

FIG. 4*b* shows another embodiment of a clamp half having a block 14 having a hole 15 corresponding in function to the hole 13. This block 14 is securely pivoted into a hole 13 of the main body piece of this clamp. This clamp half 11' should be used in combination with the clamp half 11 of FIG. 4*a*. When the block 14 of this clamp half 11' is connected to the U-shaped bracket of a screw body jack, the screw body jack may be rotated about two axial lines; i.e., an axial line perpendicualr to the plane of the bracket half 11' and another axial line perpendicualr thereto passing through the lateral hole 15, with the block 14 functioning as a universal coupling.

Figure 5:
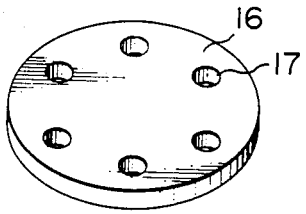
FIG. 5 is a perspective view showing an embodiment of a central bracket piece.

FIG. 5 shows an embodiment of a central bracket piece 16 having six holes 17 at an equal interval along a circumferential line. This central bracket piece 16 may be used for connecting a plurality of body jack members when they are to achieve a single task of correcting a deformation of a metallic frame and the description of the manner of using such a central bracket piece will be found later in this specification. However, it should be pointed out that the number of holes and their arrangement can be selected quite arbitrarily according to the specific need.

Figure 6:
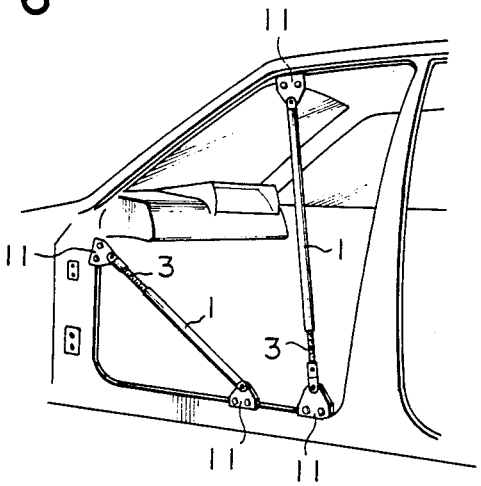
FIG. 6 is a perspective view illustrating a manner of using a screw body jack according to this invention.

FIG. 6 shows a manner in which a screw body jack may be individually used. As shown in this drawing, the screw body jack may be used for pulling together or pushing apart a metallic frame structure in this case consisting of a front door opening of a passenger car. After connecting a screw body jack shown in FIGS. 1 or 3 by way of a clamp pair shown in FIG. 4*a*, a rod not shown in the drawings is inserted into the hole 4 of the screw rod head 3*a* and the screw rod 3 is rotated or twisted in either direction for achieving either tension or compression. Since the screw engagement remains stable over a long time interval as opposed to a hydraulic body jack in which some leakage of hydraulic oil is unavoidable, the screw body jack may be conveniently used for keeping the distance of two parts of a body member fixed or as a jig for working on the surrounding portion of the body member.

Figure 7:
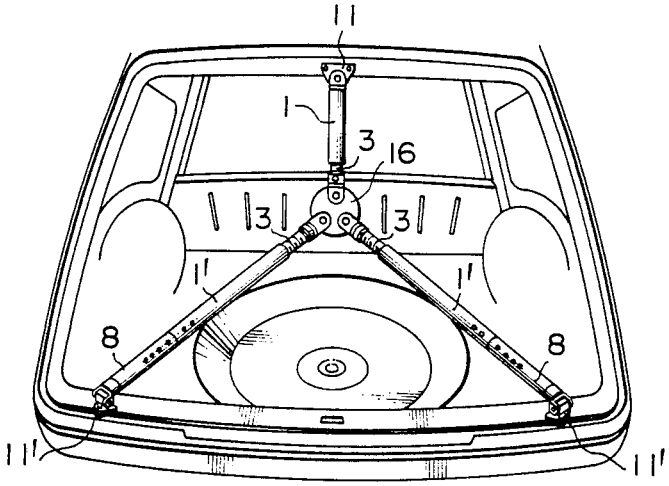
FIG. 7 is a perspective view illustrating a manner of using a body jack assembly according to this invention using three body jack elements.

FIG. 7 shows a manner in which three body jack members and a central bracket piece 16 are used for producing force in three directions. Through this arrangement, it is possible to achieve a comprehensive correction of a body member deformation as opposed to the case of a conventional body jack which can produce force only in one direction.

Also all of the body jack elements may not be freely adjustable screw body jacks. As long as at least one of them is a freely adjustable body jack, preferably the screw body jack as disclosed in this specification, the rest of the body jack elements may be semi-adjustable body jacks for instance having a telescopic structure whose overall length may be adjusted stepwise or may be simple rods having a proper clamping or connecting means at each end.

As for the clamps for connecting the body jack elements to the car body, clamps such as those shown in FIGS. 4*a* and 4*b* may be selectively used depending on the configuration of the part of the car body at which the particular clamp is to be actually clamped on.

Figure 8:
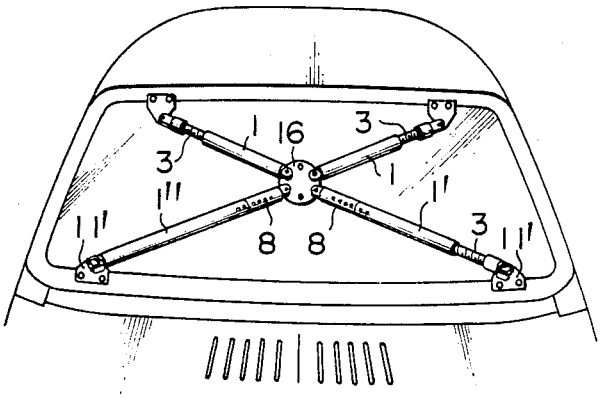
FIG. 8 is a perspective view illustrating a manner of using the body jack assembly according to this invention using four body jack elements and a central bracket piece.

FIG. 8 shows an example of using four body jack elements and the central bracket piece 16 for correcting the deformation in the front window opening of a car body. Through this arrangement, it is possible to achieve highly accurate correction of a car body opening even to fit in highly rigid member such a front window glass pane.

Figure 9:
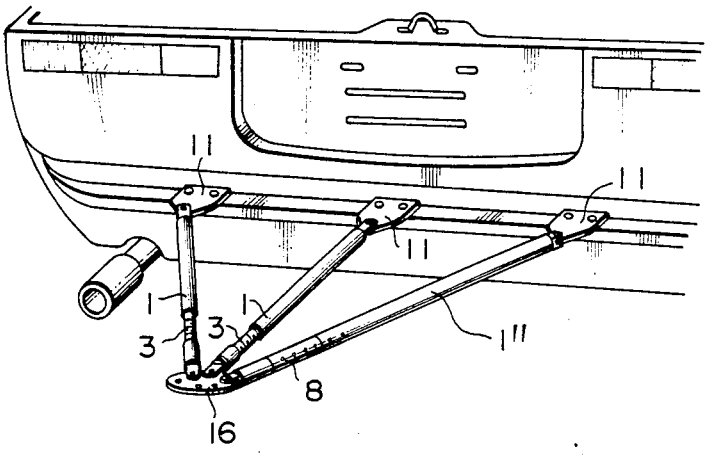
FIG. 9 is a perspective view illustrating a manner of using three body jack elements and a central bracket piece according this invention with at least one of the body jack elements in tension while others are in compression.

FIG. 9 shows an example of using three body jack elements 1, 1 and 1" in combination with a central bracket piece 16. Since all the jack elements are directed on one side over an angle less than 180 degrees, the central body jack element may be utilized in tension while the other two on both sides thereof are in compression and vice versa for correcting for instance a bent bumper. Through this arrangement, it is possible to eliminate the need for a support which is otherwise necessary for taking up the reaction force which will be produced in the process.

As may be readily noted, one of the body jack elements 11' is not provided with a screw rod but only with a telescopic arrangement using an external and inernal tubes 1" and 8 and its overall length is variable only on stepwise basis. As will be obvious to a person skilled in the art, when a plurality of body jack members are to be used in combination, it suffices if at least one of the body jack elements consists of a screw body jack as shown in FIGS. 1 and 3.

Although the present invention has been described in regard to specific embodiments thereof, it is obvious to a person skilled in the art that various modifications and variations are possible without departing from the spirit of the invention described in the appended claims.

What is claimed is:

1. A body jack assembly for correcting the deformation of a metallic structure or for deforming a metallic structure, comprising:

at least one screw body jack element whose length may be adjusted even under tension or compression;

at least two more body jack elements which are capable of supporting either compression or tension;

a circular central bracket piece having a coupling means comprising several holes disposed in a circular array for pivotally connecting one end of each of the body jack elements in a plurality of configurations to permit said jack elements to be used to produce forces in desired directions in both tension and compression, namely (a) all in tension, (b) all in compression and (c) some in tension and some in compression;

clamping means having mounting means by which it may be securely clamped in a fixed orientation on the metallic structure whose deformation is to be corrected and are each adapted for pivotal connection with the other end of each of the body jack elements.

2. A body jack assembly according to claim 1, wherein the body jack elements extend radially from the central bracket piece over an angle in excess of 180 degrees.

3. A body jack assembly according to claim 1, wherein the body jack elements extend radially from the central bracket piece over an angle no more than 180 degrees whereby at least one of the body jack element is utilized in tension while the others are in compression.

4. A body jack assembly according to claim 2 wherein the clamping means are each connected to the corresponding body jack element by way of a universal coupling.

5. A body jack assembly according to claim 1, wherein the central bracket piece is a disc having six holes at an equal interval along a circumferential line about the center of the disc.

* * * * *